US008322667B2

(12) United States Patent
Zannoni

(10) Patent No.: US 8,322,667 B2
(45) Date of Patent: Dec. 4, 2012

(54) HOLDER FOR ATTACHMENT TO CHAIN LINK FENCE

(76) Inventor: William J. Zannoni, Dracut, MA (US)

( * ) Notice: Subject to any disclaimer, the term of this patent is extended or adjusted under 35 U.S.C. 154(b) by 401 days.

(21) Appl. No.: 12/777,953

(22) Filed: May 11, 2010

(65) Prior Publication Data

US 2010/0282935 A1 Nov. 11, 2010

Related U.S. Application Data

(60) Provisional application No. 61/177,013, filed on May 11, 2009.

(51) Int. Cl.
*F21V 35/00* (2006.01)

(52) U.S. Cl. ..... 248/220.41; 248/308; 248/311.2

(58) Field of Classification Search ..... 248/311.2, 248/303, 339, 304, 308, 224.8, 220.41; 256/32, 256/33; 40/611.01, 550, 583, 607.15, 622
See application file for complete search history.

(56) References Cited

U.S. PATENT DOCUMENTS

| | | | | |
|---|---|---|---|---|
| 3,790,118 | A * | 2/1974 | Warren et al. | 248/311.2 |
| 3,860,210 | A * | 1/1975 | Berardinelli et al. | 248/308 |
| 4,340,144 | A | 7/1982 | Cousins | |
| 4,953,817 | A | 9/1990 | Mosteller | |
| 5,441,239 | A | 8/1995 | Watson | |
| 5,582,377 | A | 12/1996 | Quesada | |
| 5,749,765 | A | 5/1998 | Stopperan | |
| 5,959,255 | A * | 9/1999 | Langlie et al. | 174/161 F |
| 5,975,789 | A | 11/1999 | Mathews | |
| 6,592,102 | B2 | 7/2003 | Telles | |
| 6,669,175 | B2 | 12/2003 | Snow et al. | |
| 6,996,928 | B1 | 2/2006 | Lux et al. | |
| 7,076,898 | B1 | 7/2006 | Hunt | |
| 7,165,760 | B2 * | 1/2007 | Campbell | 256/34 |
| 2007/0210228 | A1 * | 9/2007 | Brenner et al. | 248/311.2 |
| 2010/0084531 | A1 * | 4/2010 | Schuchman | 248/311.2 |
| 2011/0100939 | A1 * | 5/2011 | Friesch | 211/85.7 |

* cited by examiner

*Primary Examiner* — Ramon Ramirez
(74) *Attorney, Agent, or Firm* — Peter A. Nieves; Sheehan Phinney Bass + Green PA

(57) ABSTRACT

An apparatus and method for manufacturing an apparatus for attaching items to a chain link fence. The apparatus has a flat base with an attachment side having legs with grooves or lips to hook or attach to a chain link fence. The apparatus has a utility side opposite the attachment side. The utility side may be substantially flat to display symbols so that multiple apparatus form a sign. The utility side may include an integral beverage holder, hooks, tiedown loops, or a hook-and-loop fastener. The utility side may be integral to the side of a bottle, such that the bottle may be supported by a chain link fence. The utility side may support a clasp system, where one portion of the clasp is attached to the base of the apparatus, and the second portion of the clasp is attached to an item to be supported, such that the item may be attached to the base or removed from the base by engaging or disengaging the clasp.

22 Claims, 14 Drawing Sheets

TOP VIEW

REAR VIEW

SIDE VIEW

FRONT VIEW

SIDE VIEW

TOP VIEW

HOLDER FOR ATTACHMENT TO CHAIN LINK FENCE

CROSS-REFERENCE TO RELATED APPLICATIONS

This application claims the benefit of U.S. Provisional Patent Application Ser. No. 61/177,013, filed May 11, 2009, entitled "Holder for Attachment to Chainlink Fence," which is incorporated in its entirety herein.

FIELD OF THE INVENTION

The present invention is generally related to holders, and more particularly is related to a holder for attachment to a chain link fence.

BACKGROUND

Spectators and participants present at baseball games or similar sporting events or other such activities often consume beverages as they watch or participate. At such times, drinks in the form of bottles, cans, and similar containers are often placed on benches, atop fences, or on the ground. Drinks so placed are easily toppled and spilled, and frequently become muddy or soiled. Moreover, with only the drink itself to distinguish it from other drinks similarly placed in such locations, it is easy for a person to mistake his drink for that of someone else.

Chain link fences are common features at forums where sporting events are held. At such sporting events or other activities where a chain link fence is present, spectators will sometimes insert plastic cups, for example, into the meshwork holes of the chain link fence to spell out the name of their favored team or player. More generally, similar artifices have been used as a form of crude signage to communicate advertising, announcements, and various other textual messages and/or simple graphical content. However, where the improvised sign elements do not themselves contain lettering or other symbols but only form recognizable characters through arrangement in patterns of letters, numbers, or the like, even a concise message may require a large number of plastic cups or other such improvised sign elements, and insertion of such a large number of sign elements in the meshwork holes of the chain link fence may prove time-consuming. Furthermore, as such improvised sign elements such as plastic cups are often of such shape and dimensions as to make them only barely suitable for such purpose, it is not surprising to find that these improvised sign elements easily become dislodged from the chain link fence.

In addition, in situations where the so-called fabric of a chain link fence has diamond-shaped meshwork holes, it is typically the case that interweaving of the wire making up the chain link fence causes the wire at two sides of each such diamond-shaped hole to be in a different plane than the wire at the other two sides of the diamond-shaped hole. Proposed methods of mounting an object to a chain link fence that fail to account for this stepped topology of the chain link fence may suffer from drawbacks such as failure to securely grip the chain link fence wire at all four sides of the meshwork hole, unsightly skewing of signage or other object being attached to the chain link fence, as well as nonuniformity in alignment from sign element to sign element (or other such object being mounted to the chain link fence) due to chance variation in mounting when the direction of such skewing can vary depending on mounting orientation.

Therefore, there is a heretofore unaddressed need in the industry to address the aforementioned deficiencies and inadequacies, such as to provide a manner for securely holding items to fences.

SUMMARY

One aspect of the present invention is a holder apparatus for attaching items to a chain link fence. A chain link fence has generally diamond-shaped openings framed by two pairs of parallel wires. For each opening, a first pair of frame wires is in a shallow plane, and the second pair of frame wires is in a deep plane. The holder has a flat base having a fence attachment side which, when deployed, is adjacent to the fence, and a utility side opposite to the attachment side. The base is bounded by a perimeter having a perimeter edge. The apparatus attaches to the fence with two pairs of legs. Each leg has a proximate end that is attached to the attachment side of the base, and a wire engaging feature attached to the distal end of the leg. The legs are attached to the base at attachment points substantially within the base perimeter. A deep pair of legs attaches to the deep pair of frame wires, and a shallow pair of legs attaches to the shallow pair of frame wires.

The holder may attach to the fence by inserting both the shallow pair of legs and the deep pair of legs within a single diamond-shape hole in the chain link fence. The holder may be fastened to the fence by rotating the base approximately 45 degrees. The holder may have a rotation stop that prevents the holder from turning past 45 degrees. Alternatively, the holder may be formed of a semi-rigid material so that a leg can flex to facilitate insertion of the legs through a fence hole past the framing wires. Alternatively, the holder may be attached to the fence by inserting the first shallow leg and the first deep leg through a first diamond-shaped hole, and inserting the second shallow leg and the second deep leg through a second diamond-shaped hole. In one such embodiment, the base may be integral to the side of a bottle, with the utility side forming at least a portion of an interior wall of the bottle.

The engaging feature may be a lip that projects outward from the leg at an angle in a range between 30 and 90 degrees, such that the lip partially wraps around a framing wire. Or the engaging feature may have an upper lip and a lower lip projecting outward from the leg, with the upper lip and the lower lip being substantially parallel and spaced to form a groove to clasp a framing wire. The holder may be formed of a deformable elastic material, such as foam or sponge rubber.

The utility side of the holder base may be a substantially flat surface that may display a symbol, such that multiple holders may be used in concert to form a sign. The utility side may alternatively support a beverage holder. The beverage holder may have a ledge with a proximal portion attached to the base, a middle portion extending horizontally outward from the base for supporting a beverage container, and a distal portion that connects to the middle portion at an elbow. The ledge distal portion projects vertically upward from the middle portion and may further secure the beverage container. The ledge may have a first hinge located at the elbow and a second hinge connecting the ledge proximal portion to the ledge middle portion, allowing the ledge to fold up and collapse against the base.

In another embodiment, a portion of the utility side bears one component of a hook-and-loop fastener system, such Velcro® (registered trademark of Velcro Industries B.V. of Manchester, N.H., USA). In yet another embodiment, the base utility side has a tiedown loop that may be used to attach, for instance, a string or twine.

Another aspect of the current invention is a method for manufacturing a chain link fence fastener apparatus. The steps include forming a generally flat base having a fence attachment side and a utility side opposite the fence attachment side, and forming a plurality of legs, each leg having a proximal end attached to the base fence attachment side and a distal end projecting outward from the plane of the base. Each leg has a wire engaging feature attached to the distal end. The legs include a deep pair of legs having a first deep leg and a second deep leg and a shallow pair of legs having a first shallow leg and a second shallow leg, where the shallow pair of legs is shorter than the deep pair of legs. The forming step may involve injection molding, or blow molding.

Another aspect of the current invention is a system for attaching items to a chain link fence with a plurality of generally diamond-shaped openings, as described above. The system has a generally flat base with a fence attachment side and a utility side disposed opposite the fence attachment side, and a perimeter bounded by a base perimeter edge. As with the holder described above, the base fastens to the chain link fence with a deep pair of legs and a shallow pair of legs. The shallow pair of legs is shorter than the deep pair of legs, and each leg has a wire engaging feature attached to its distal end. The system includes a clasp for attaching a variety of removable holders to the base. The clasp includes a female member attached to the base utility fastener side, a clasp member removably attached to the female member, and a holder, attached to the clasp male member. The holder may be a beverage holder.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present invention provides a holder for attachment to a chain link fence.

Figure 1:
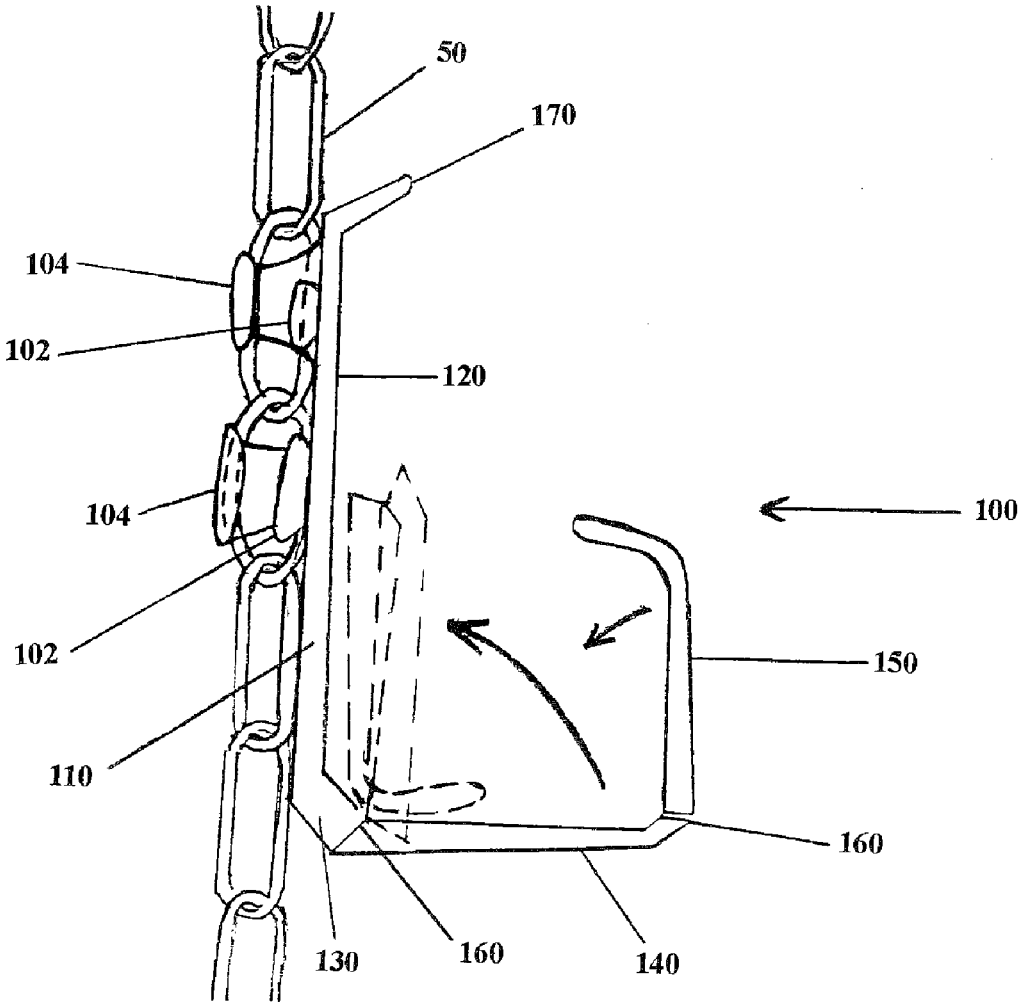
FIG. 1 is a side view of a holder in accordance with a first embodiment of the present invention.
Figure 2:
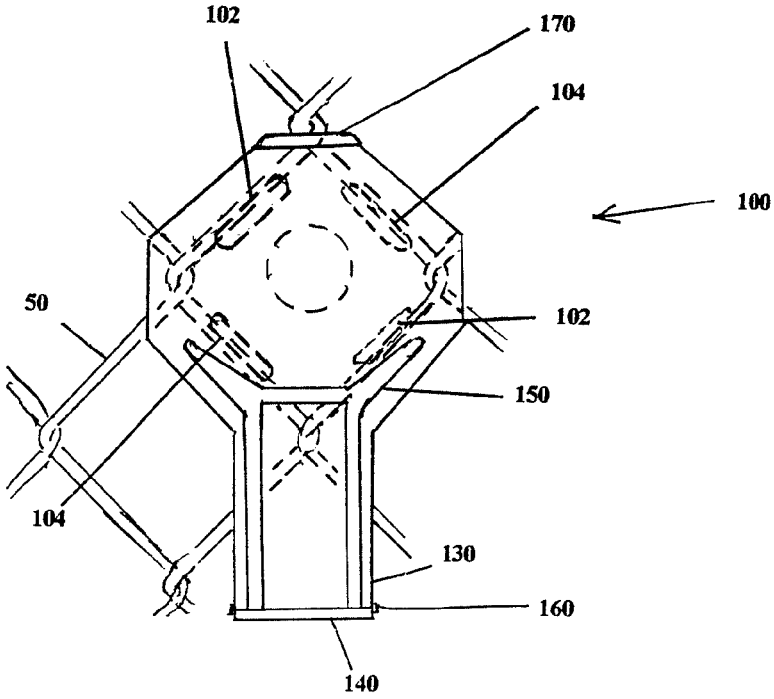
FIG. 2 is a front view of the holder of FIG. 1.
Figure 3:
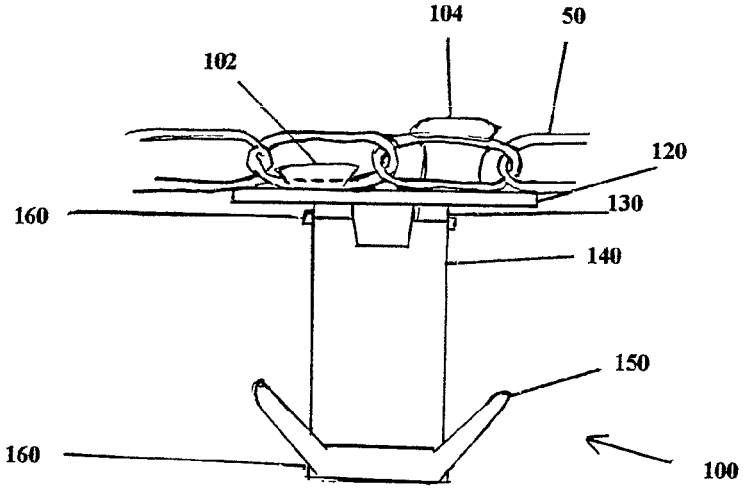
FIG. 3 is a top view of the holder of FIG. 1.
Figure 4:
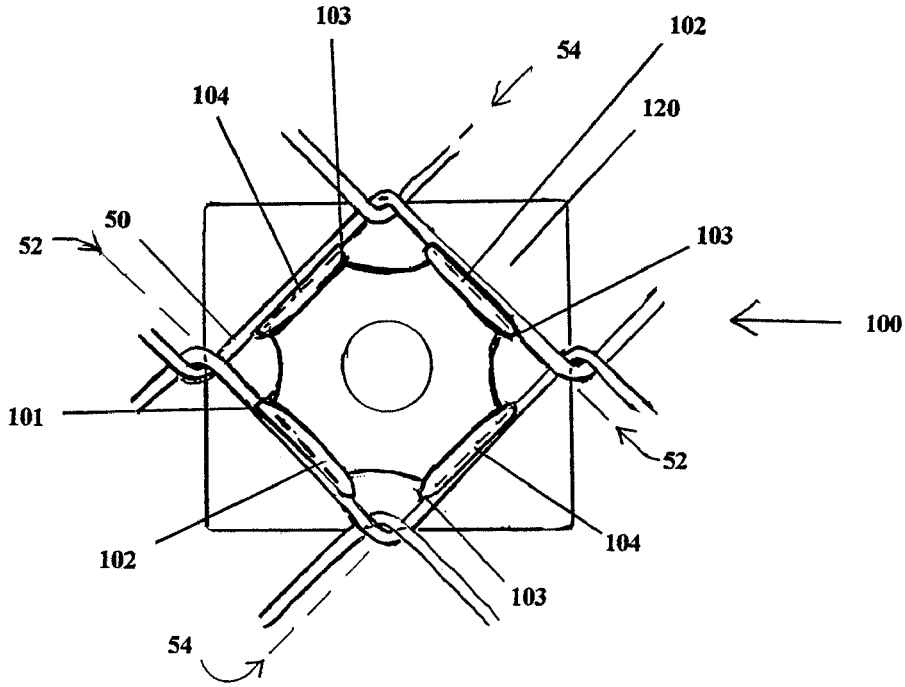
FIG. 4 is a partial rear view of the holder of FIG. 1.
Figure 5:
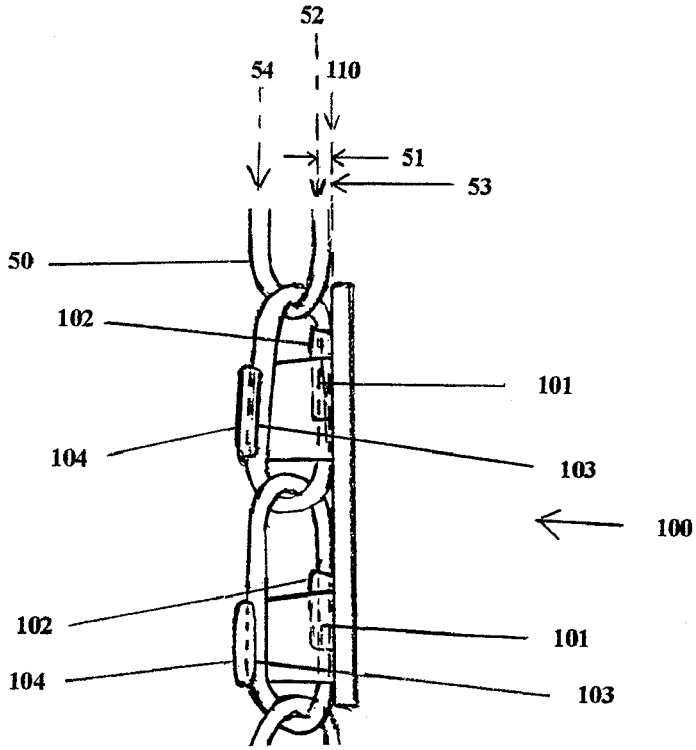
FIG. 5 is an enlarged side view of a portion of a holder similar to that shown in FIG. 1.
Figure 6A:
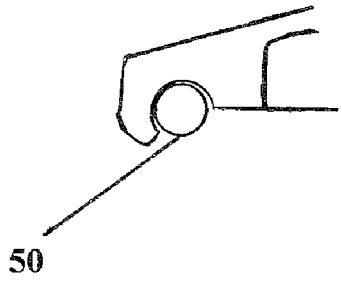
FIG. 6 collectively shows a top view, FIG. 6A, a rear view, FIG. 6B, and a side view, FIG. 6C, of a first variation on the holder shown in FIG. 1.
Figure 6B:
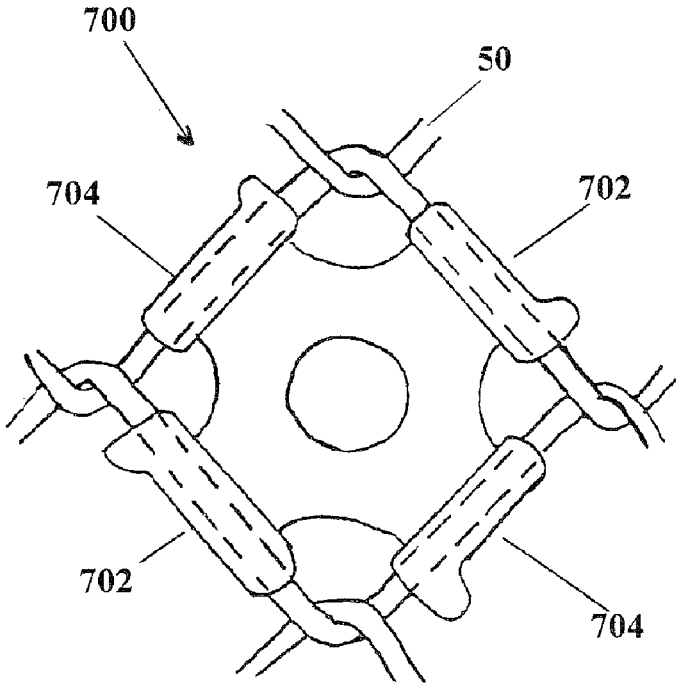
Figure 6C:
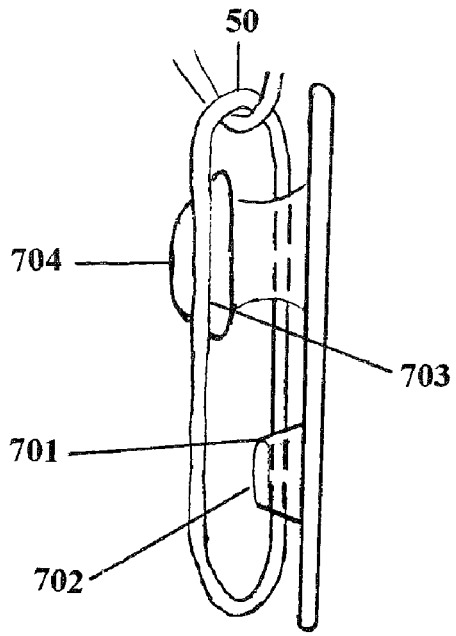
Figure 6C:
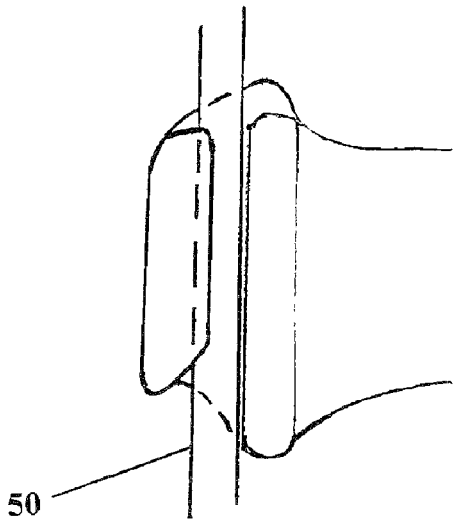

A drink holder that snaps into and snaps out of a chain link fence in accordance with a first embodiment of the present invention is shown in FIGS. 1 through 4, a side view thereof being shown in FIG. 1, a front view thereof being shown in FIG. 2, a top view thereof being shown in FIG. 3, and a rear view thereof being shown in FIG. 4. Moreover, an enlarged side view of a portion of a snap-in/snap-out drink holder similar to that shown in FIG. 1 is shown in FIG. 5.

Note that in the description that follows, except where otherwise clear from context, directions are defined in terms of the configuration of the holder 100 as it appears when installed on a chain link fence 50, such that "back" or "rear" means in a direction toward the chain link fence 50 from the bulk of the holder 100, "front" means in a direction opposite back, and "top" and "bottom" are defined relative to the vertical, as a drink would typically be placed in a drink holder 100 in such orientation relative to the vertical as to avoid spillage by aligning the top, or opening, of the drink with the top of the holder, and by aligning the bottom, or end opposite the top, of the drink with the bottom of the drink holder 100.

Referring to FIGS. 1 through 3, the drink holder 100 in accordance with the first embodiment of the present invention contains a base 120 having a back face 110 that faces the chain link fence 50 when the holder 100 is installed on the chain link fence 50. Extending approximately perpendicularly from the back face 110 of the base 120 are two pairs of legs 102, 104 that engage with the wires making up the meshwork of the chain link fence 50 when the holder 100 is installed thereon.

Extending from the bottom of the base 120 when the holder 100 is in its installed configuration is a ledge-like projection that projects frontward to form a floor for placement of a drink thereon. In the present embodiment, this ledge-like floor contains a proximal portion 130, a middle portion 140, and a distal portion 150, hinges 160 between the proximal portion 130 and the middle portion 140, and between the middle portion 140 and the distal portion 150, allowing the floor to be collapsed as shown by the arrows in heavy outline at FIG. 1. In collapsing the floor of the holder 100 shown in FIG. 1, the distal portion 150 would first be folded down onto the middle portion 140, and the middle portion 140 together with the distal portion 150 would then be folded up against the proximal portion 130. When the floor is collapsed in such fashion, the more or less flat profile of the holder facilitates transport and storage. Deployment of the hinged floor of the drink holder 100 is carried out by performing these steps in reverse. Although the floor is shown as hinged here, there is no particular objection to employment of a solid floor. Furthermore, as best seen at FIG. 3, the distal portion 150 in the present embodiment preferably forms a more or less arcuate guide that facilitates insertion of a drink therewithin and helps prevent such a drink from falling out therefrom.

Extending from the top of the base 120 when the holder 100 is in its installed configuration is a cap-like projection that projects frontward at a slight angle upward relative to a perpendicular drawn frontward from the plane of the back face 110 so as to form a roof 170 for additional guidance and support of a drink when the drink is placed in the drink holder 100.

Referring now to FIGS. 4 and 5, the manner in which the legs 102, 104 grip the wire of the chain link fence 50 when the holder 100 is attached to the chain link fence 50 will be described in further detail.

As best seen at FIG. 4, a typical chain link fence 50 contains a so-called fabric portion made up of wire interwoven so as to form meshwork in which holes are present. For example, a typical chain link fence 50 might have a fabric portion made up of 9 gauge (approximate diameter 0.15 inch) galvanized stainless steel that is interwoven to form meshwork having 2 inch×2 inch diamond-shaped holes, which is to say that the meshwork holes are 2 inches on a side. Although this example has been given for illustrative purposes, there is no particular objection to use of wire of different material and/or different gauge to form meshwork having holes of the same or different size and/or shape, with appropriate modifications being made to the dimensions of the holder 100 so as to accommodate the holes in the meshwork of the chain link fence 50.

Interweaving of the wire that makes up the chain link fence 50 as shown at FIG. 4 causes the wire at two sides of each such diamond-shaped hole to be in a different plane than the wire at the other two sides of the diamond-shaped hole. For example, at FIG. 4, the wire at the top left and at the bottom right in the drawing will extend further out of the plane of the paper toward the reader than the wire at the top right and at the bottom left in the drawing. That is, since FIG. 4 is a rear view of the holder 100 shown in FIGS. 1 through 3, an enlarged side view of a portion of which is moreover shown in FIG. 5, the pair of legs 104, 104 that engage with the wire at the top left and at the bottom right in FIG. 4 will preferably extend further from the base 120 of the holder 100 than the pair of legs 102, 102 that engage with the wire at the top right and at the bottom left in FIG. 4. For this reason, in the present embodiment, one pair of legs will be referred to as deep legs 104, 104, and the other pair of legs will be referred to as shallow legs 102, 102. Note that the term "wire" or "the wire" is generally used in a collective sense herein, no distinction being made with respect to singular or plural or to which strand of wire it is that is actually engaging with which leg of the holder 100; that is, strictly speaking, at FIG. 4, the strand of wire at top left is the same strand of wire as at bottom left, and the strand of wire at top right is the same strand of wire as at bottom right, but for ease of description, reference is consistently made herein simply to "wire" or "the wire" in the collective sense of the word, without intending to distinguish whether it is one strand or two, or whether it is the same or a different strand, that is being referred to.

This difference in extension of the shallow legs 102, 102 and the deep legs 104, 104 from the back face 110 of the base 120 to permit engagement with wire at different depths in the topology of the chain link fence 50 is more readily apparent in the side view of FIG. 1 and the top view of FIG. 3.

Before continuing, the reader should be cautioned about a liberty taken in the drawings with regard to portrayal of the chain link fence 50. At the side views of FIGS. 1, 5, 7, 9, 10, and the top view of FIG. 3, note that interweaving of strands of wire in the chain link fence 50 has not been shown as it would actually appear, e.g., as two strands weaving in and out to left and to right as one goes from top to bottom of the chain link fence 50, but has instead been simplified and approximated by portrayal as closed loops (after the fashion of welded chain) in the drawings. For example, the actual situation of interweaving of wire in a chain link fence 50 is shown more closely in FIG. 15. The reader should take note that notwithstanding this simplified portrayal of the meshwork of the chain link fence 50, the holder 100 of the present embodiment is in fact intended to be attached to chain link fence 50 having interwoven strands.

Returning to FIGS. 4 and 5, the manner in which the legs 102, 104 of the holder 100 grip the wire of the chain link fence 50 will now be described. FIG. 4 is a partial rear view of the drink holder 100 shown in FIGS. 1 through 3. FIG. 5 is an enlarged side view of a portion of the drink holder 100 shown in FIGS. 1 through 4.

Referring to FIG. 5, the topology of the chain link fence 50 is such that the wire making up the meshwork of a typical interwoven chain link fence 50 will lie predominantly in two planes, as has been mentioned. As measured from the plane of the back face 110 of the base 120 of the holder 100, it can be seen that the wire of such a chain link fence 50 lies in a near plane and a far plane. The near (shallow) plane of the chain link fence 50 corresponds to the shallow legs 102, 102 of the holder 100. The far (deep) plane of the chain link fence 50 corresponds to the deep legs 104, 104 of the holder 100. That is, at the rear view of FIG. 4, it can be seen that the shallow legs 102, 102 of the holder 100 engage with wire in the shallow plane of the chain link fence 50. More specifically, shallow engaging features 101, 101 on the shallow legs 102, 102 engage with the wire in the shallow plane of the chain link fence 50. Moreover, it can be seen at FIG. 4 that the deep legs 104, 104 of the holder 100 engage with wire in the deep plane of the chain link fence 50. More specifically, deep engaging features 103, 103 on the deep legs 104, 104 engage with the wire in the deep plane of the chain link fence 50.

As best understood by referring to the dimensions indicated in the upper portion of FIG. 5, a shallow plane depth 51 is here taken to be approximately a distance from the plane of the back face 110 of the base 120 of the holder 100 to a centerline 52 (hereinafter "shallow plane wire centerline 52") of the wire lying in the shallow plane of the chain link fence 50. Furthermore, a deep plane depth 53 is here taken to be approximately a distance from the plane of the back face 110 of the base 120 of the holder 100 to a centerline 54 (hereinafter "deep plane wire centerline 54") of the wire lying in the deep plane of the chain link fence 50. For example, a chain link fence 50 made up of 9 gauge wire interwoven to form diamond-shaped holes that are 2 inches on a side might have a shallow plane depth 51 of approximately 0.07 inch (roughly one half of the diameter of the chain link fence wire), and might have a deep plane depth 53 of approximately 0.57 inch. The difference between the shallow plane depth 51 and the deep plane depth 53 in such an example would be approximately 0.5 inch.

Depending on the engaging features 101, 103 employed, the holder 100 may be designed such that the back face 110 of the base 120 of the holder 100 is more or less flush with (abutting) the wire in the near plane of the chain link fence 50 when the holder 100 is in its installed configuration as shown in the views at FIGS. 1, 3, and 5, in which case the shallow plane depth 51 will be approximately one half of the diameter of the wire of the chain link fence 50 (approximately 0.07 inch in the present example). Moreover, in holders 100 designed for flush installation, it may be preferred that the back face 110 of the base 120 be made planar. Such a flush configuration may be preferred, for example, when the back face 110 of the base 120 of the holder 100 cooperates with the engaging features 101, 103 to locate and/or secure the holder 100 in place relative to the chain link fence 50. For example, where splayed tabs are employed as engaging features 101, 103, such as is the case in the example shown in FIGS. 1 through 5, a flush installed configuration may be preferred so as to prevent play in the front-to-back direction when the holder 100 is installed on the chain link fence 50. This will typically be the case where such tabs serve as engaging features 101, 103 to prevent movement of the holder 100 in a frontward direction, but not necessarily to prevent movement of the holder 100 in a rearward direction, when the holder 100 is in its installed configuration.

Alternatively, for example where grooves disposed at the outside circumferential surface of the legs 102, 104, such grooves having radius of curvature not less than the radius of curvature of the wire of the chain link fence 50, are employed as engaging features 101, 103 for engagement with the wire of the chain link fence 50, to the extent that such grooves may act to prevent movement of the holder 100 in both a frontward and a rearward direction when the holder 100 is in its installed configuration, because cooperation with the back face 110 of the base 120 of the holder 100 may in such case not be necessary to locate and/or secure the holder 100 in place relative to the chain link fence 50, there would be no particular objection to employment of a standoff distance separating the back face 110 of the base 120 of the holder 100 from the chain link fence 50. That is, in such case, there would be no particular objection to employment of a shallow plane depth 51 that is greater than one half of the diameter of the wire of the chain link fence 50 (approximately 0.07 inch in the present example). Where such a standoff distance is employed, it will generally be preferred to increase the deep plane depth 53 by a corresponding amount so as to more or less maintain a constant difference between the deep plane depth 53 and the shallow plane depth 51 (approximately 0.5 inch in the present example) so as that the plane of the back face 110 of the base 120 of the holder 100 is more or less parallel with the plane of the chain link fence 50, and holder features such as the floor 130, 140, 150 and the roof 170 project frontward in more or less perpendicular fashion with respect to the plane of the chain link fence 50.

However, regardless of the type of engaging features 101, 103 employed, it is preferred that the difference in depth (magnitude of extension toward the chain link fence 50 in a direction perpendicular to the back face 110 of the base 120 of the holder 100) between the shallow engaging features 101, 101 on the shallow legs 102, 102 and the deep engaging features 103, 103 on the deep legs 104, 104 be chosen so as to more or less correspond to the difference between the shallow plane depth 51 and the deep plane depth 53 of the chain link fence 50, this difference being approximately 0.5 inch in the present example. This will allow the shallow and deep engaging features 101, 103 to engage with the wire in the shallow and deep planes of the chain link fence 50 when the holder 100 is in its installed configuration.

When the holder 100 of the first embodiment is installed on a chain link fence 50, the legs 102, 104 engage with the wire making up the meshwork of the chain link fence 50 so as to hold the base 120 of the holder 100 securely to the chain link fence 50. The legs 102, 104 are therefore preferably arranged in a pattern more or less corresponding to the dimensions of the meshwork hole in the chain link fence 50. For example, as best seen at FIG. 4, for a nominal 2 inch×2 inch hole as in the present embodiment, the distance between the respective shallow legs 102, 102 is preferably on the order of 2 inches, and the distance between the respective deep legs 104, 104 is likewise preferably on the order of 2 inches.

More subtly, the respective legs 102, 104 in some embodiments have engaging features 101, 103 near their ends or at other suitable locations, and depending on the manner in which these engaging features 101, 103 are intended to work, it may be the case that the critical surfaces of the engaging features 101, 103 on each pair of legs 102, 104 are preferably mutually separated, when in their undeflected state, by a distance that is slightly less than or slightly more than the nominal 2 inch hole size. What is meant here by the critical surfaces of the engaging features 101, 103 may vary somewhat depending on the specific design of such engaging features 101, 103, but in general such critical surfaces include the surfaces of the legs 102, 104 that make contact with the wire of the chain link fence 50 when the holder 100 is in its installed configuration.

For example, at FIGS. 1 through 5 but best seen at FIGS. 4 and 5, tab-like bends of approximately 90 degrees may be employed as engaging features 101, 103, these tabs being splayed outward in the embodiment shown in FIG. 5, which is to say that that the outside circumferential surface of the legs 102, 104 are intended in the present embodiment to contact the inside circumferential surface of the diamond-shaped meshwork hole in the chain link fence 50 (such an arrangement is referred to herein as an "outwardly sprung" configuration). Of course, such tabs may alternatively be splayed inward, in which case it would be the inside circumferential surface of the legs 102, 104 that would be intended to contact the outside circumferential surface of the diamond-shaped meshwork hole in the chain link fence 50 (such an arrangement is referred to herein as an "inwardly sprung" configuration). In some embodiments, alternatively or in addition to such tabs, grooves may be employed as engaging features 101, 103, with critical surfaces being defined similarly. Of course, there is no objection to employing tabs on some legs 102, 104 and grooves on other legs 102, 104 of the same holder 100, and there is likewise no objection to having one pair of legs 102, 104 be inwardly sprung while the other pair of legs 102, 104 is outwardly sprung. Note that where "inside circumferential surface" and "outside circumferential surface" are said above, this is not to imply that such surfaces necessarily have circular cross-section, as these terms are used merely as a convenient way to indicate what is radially inside and what is radially outside, regardless of exact shape.

In embodiments having inwardly sprung and/or outwardly sprung pairs of legs 102, 104, the material and dimensions of the legs 102, 104 are preferably chosen so as to impart the legs 102, 104 with elasticity sufficient to allow respective pairs of legs 102, 104 to flex in a direction that increases or decreases the separation between the critical surfaces of the engaging features 101, 103 relative to the undeflected state so as to produce a restoring force suitable for locating and/or gripping the holder 100 to the chain link fence 50. That is, where elasticity of the legs 102, 104 is utilized in outwardly sprung or inwardly sprung designs, separation between such critical surfaces is preferably chosen to achieve a suitable restoring force such as will allow easy installation and removal but will also permit secure attachment when the holder 100 is installed on the chain link fence 50.

For example, in the embodiment shown in FIGS. 1 through 5, the respective critical surfaces of the outwardly sprung tab-like bends that serve as shallow engaging features 101, 101 at the ends of the shallow legs 102, 102 are preferably separated, when in their undeflected state, by a distance that is somewhat greater than the nominal meshwork hole size so as to provide an appropriate restoring force for easy installation and removal but also permit secure attachment when the holder 100 is installed on the chain link fence 50. Similarly, the respective critical surfaces of the outwardly sprung tab-like bends that serve as deep engaging features 103, 103 at the ends of the deep legs 104, 104 are preferably separated, when in their undeflected state, by a distance that is somewhat greater than the nominal meshwork hole size.

Procedures for installation and removal will vary depending on the design employed. For example, the holder 100 having outwardly sprung tab-like bends as engaging features 101, 103 in the embodiment shown in FIGS. 1 through 5 may be installed and removed in straight-in/straight-out fashion or in twist-in/twist-out fashion.

In straight-in/straight-out (or snap-in/snap-out) installation, the holder 100 is aligned with the chain link fence 50 so that the shallow legs 102, 102 are directly in front of wire in the shallow plane of the chain link fence 50, and the deep legs 104, 104 are directly in front of wire in the deep plane of the chain link fence 50, and the holder 100 is pressed straight into the meshwork hole of the chain link fence 50. Removal is the reverse of installation. Note that where it is said herein that a holder 100 is inserted into a meshwork hole of the chain link fence 50, this is used as shorthand to mean that the holder 100 is installed on the chain link fence 50, regardless of whether contact between engaging features 101, 103 and wire occurs at the inside circumferential surface or the outside circumferential surface of the meshwork hole; i.e., the holder 100 is said to be inserted into the meshwork hole regardless of whether the legs 102, 104 employ an inwardly sprung design or an outwardly sprung design or a design that is neither inwardly sprung nor outwardly sprung. Moreover, the procedure for straight-in/straight-out installation would essentially be the same for holders having inwardly sprung tabs, and for holders having grooves instead of or in addition to tabs.

During twist-in/twist-out installation, the holder 100 is first held in an orientation that is rotated approximately 45 degrees counterclockwise or clockwise relative to the straight-in/straight-out orientation (i.e., the legs 102, 104 are first aligned with the corners of the diamond-shaped meshwork hole), and the holder 100 is then pressed straight into the meshwork hole and rotated 45 degrees clockwise or counterclockwise (i.e., in a direction that will cause the shallow engaging features 101, 101 of the shallow legs 102, 102 to engage with the wire in the shallow plane of the chain link fence 50, and will cause the deep engaging features 103, 103 of the deep legs 104, 104 to engage with the wire in the deep plane of the chain link fence 50). Removal is the reverse of installation. For twist-in/twist-out installation, it is preferred that the dimensions of the legs 102, 104 be such as to allow the legs 102, 104 to clear the inside circumferential surface of the meshwork hole when the legs 102, 104 are aligned with the corners of the diamond-shaped hole and pressed straight thereinto. Note, moreover, that it is impractical to employ a sprung inward design for twist-in/twist-out installation.

Especially for straight-in/straight-out installation, it is preferred that tabs, groove walls, ridges or other such engaging features 101, 103 protrude radially (as viewed, for example, in FIG. 4) no more than necessary for locating and/or securing of the holder 100 relative to the chain link fence 50, and it is moreover preferred that such regions proximate to such engaging features 101, 103 be tapered, chamfered, or beveled at appropriate locations so as to facilitate installation and removal. Furthermore, as can be seen at the front and rear views of FIGS. 2 and 4, note that the base 120 of the holder 100 may have features, such as a hole in the center of the base and/or cutouts at the periphery of the base 120, between neighboring legs 102, 104, that serve as handholds or locations where fingers can be placed to facilitate pressing, pulling, twisting, and other motions employed during installation and removal.

FIG. 6 collectively shows a top view, FIG. 6A, a rear view, FIG. 6B, and a side view, FIG. 6C, of a holder 700 in accordance with a first variation on the holder 100 of the first embodiment described with reference to FIGS. 1 through 5. To the extent that the holder 700 in accordance with this first variation described with reference to FIG. 6 is similar in structure and/or function to the holder 100 of the first embodiment described above with reference to FIGS. 1 through 5, like parts are given like-numbered reference numerals and description thereof is omitted for brevity.

The embodiment shown in FIG. 6 is a variation on a design intended for twist-in/twist-out installation. For example, helical, tapered, chamfered, or beveled surfaces near the ends of the legs 702, 704 in the present variation may approximate helical surfaces after the fashion of screw threads so as to impart directionality to the rotation of the holder 700 as it is twisted in or twisted out of the chain link fence 50, guiding and facilitating engagement of engaging features 701, 703 with the wire of the chain link fence 50 or disengagement of the engaging features 701, 703 therefrom. For example, as a variation on the use of grooves as engaging features 701, 703 mentioned above, such grooves may be straight (parallel with the wire of the chain link fence 50) where they are designed to engage with the wire of the chain link fence 50 but curve to on the order of between 30 degrees and 60 degrees at the ends of the legs 702, 704 (i.e., toward the rear of the chain link fence 50 when the holder 700 is installed thereon) so as to open out at leg ends and more readily accept the wire of the chain link fence 50 during twist-in/twist-out installation. That is, in embodiments without such guide features, rearward portions (i.e., portions near ends of legs) of engaging features 701, 703 may interfere with insertion of the holder 700 into the chain link fence 50. For example, where a groove is employed as an engaging feature 701, 703, a ridge formed by the groove wall toward the end of the leg 702, 704 in some embodiments might interfere with insertion of the holder 700 into the chain link fence 50. Presence of helical, tapered, chamfered, or beveled surfaces, especially in combination with twist-in/twist-out installation, can therefore help to guide and facilitate entry of the holder 700 into and out of the meshwork hole of the chain link fence 50. Note that where entry of the holder 700 into the chain link fence 50 is said here, this is used as shorthand to refer to sliding contact of the outside circumferential surface of the legs 702, 704 with the inside circumferential surface of the wire bounding the meshwork hole of the chain link fence 50, or sliding contact of the inside circumferential surface of the legs 702, 704 with the outside circumferential surface of the wire bounding the meshwork hole of the chain link fence 50 (but note that sliding contact of the outside circumferential surface of the legs 702, 704 with the inside circumferential surface of the wire of the chain link fence 50 will be the preferred mode of operation for twist-in/twist-out installation).

Furthermore, optional presence of one or more stops that halt rotation during twist-in installation when the holder 700 has reached its installed configuration, and the engaging features 701, 703 of the legs 702, 704 are properly aligned and engaged with the wire of the chain link fence 50, can further facilitate proper engagement of engaging features 701, 703 with the wire of the chain link fence 50, serving as a positive stop to definitively indicate that the holder 700 is properly engaged with the chain link fence 50, and thus helping to prevent the holder 700 from being underrotated short of, or overrotated past, its preferred installed orientation.

The holders 100, 700 in accordance with the first embodiment and the first variation thereon may be manufactured using any suitable method from any suitable material or materials. For example, the holders 100, 700 in accordance with the first embodiment and the first variation thereon may be molded from thermoplastic or thermosetting resin. Furthermore, there is no particular objection to using different materials for different parts and joining the parts by bonding or any other suitable method. As mentioned above, where the legs of the holder are of sprung inward or sprung outward design, it is preferred that material and dimensions be chosen so as to provide an appropriate restoring force such as will allow easy installation and removal but will also permit secure attachment when the holder is installed on the chain link fence 50.

Figure 7:
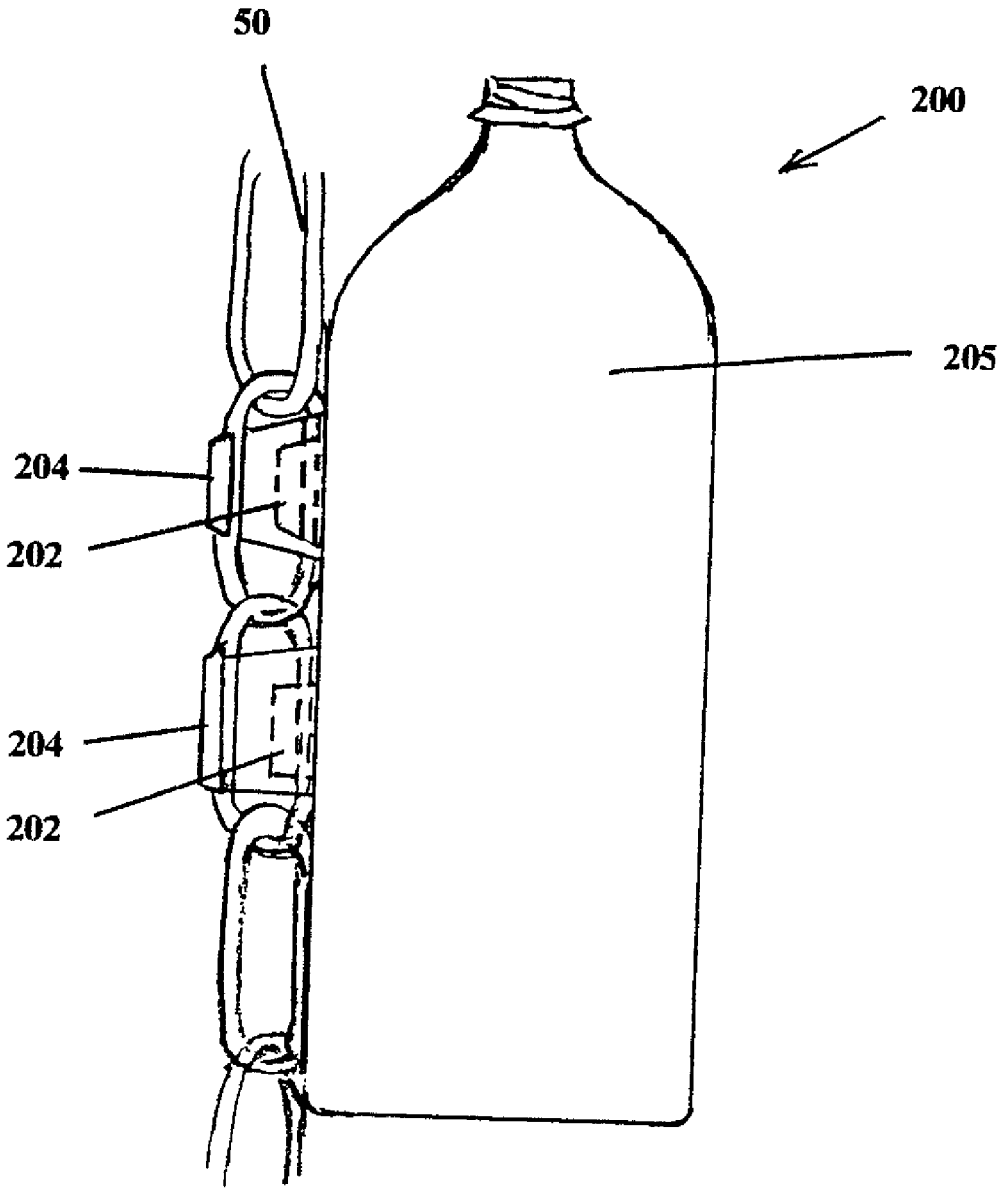
FIG. 7 is a side view of a second variation on the holder shown in FIG. 1.

Referring to FIG. 7, this shows a side view of a holder 200 in accordance with a second variation on the holder 100 of the first embodiment described with reference to FIGS. 1 through 5. To the extent that the holder 200 in accordance with this second variation described with reference to FIG. 7 is similar in structure and/or function to the holder 100 of the first embodiment described above with reference to FIGS. 1 through 5, like parts are given like-numbered reference numerals and description thereof is omitted for brevity.

In the variation shown in FIG. 7, a bottle portion 205 is integral with legs 202, 204 similar to the legs 102, 104 described with reference to FIGS. 1 through 5. Note that employment of an integral design such as is shown in the drawing permits certain of the features described with reference to FIGS. 1 through 5, such as the base 120, the floor 130, 140, 150, the hinges 160, and the roof 170 in the first embodiment shown in FIGS. 1 through 5, to be omitted or subsumed into the integral design of the present variation.

To avoid spilling of drink from the bottle portion 205 when the cap of the bottle portion 205 has been removed, straight-in/straight-out installation will be preferred.

The holder 200 in accordance with the second variation on the first embodiment may be manufactured using any suitable method from any suitable material or materials. For example, the integral holder 200 of the second variation on the first embodiment may be molded as one piece from thermoplastic or thermosetting resin such as any of a variety of resins appropriate for molding of drink containers. Furthermore, although the holder of the present variation is referred to as an integral holder 200, in accordance with a further variation thereon there is no particular objection to using different materials for different parts and joining the parts by bonding or any other suitable method. For example, although it may be preferred, where the legs of the holder are of sprung inward or sprung outward design, to employ thermoplastic or thermosetting resin for the legs 202, 204 so as to have elasticity sufficient to obtain a suitable restoring force as explained above, there is no particular objection to using metal or other such harder material for the bottle portion 205, with the two materials being joined by an appropriate method.

Figure 8:
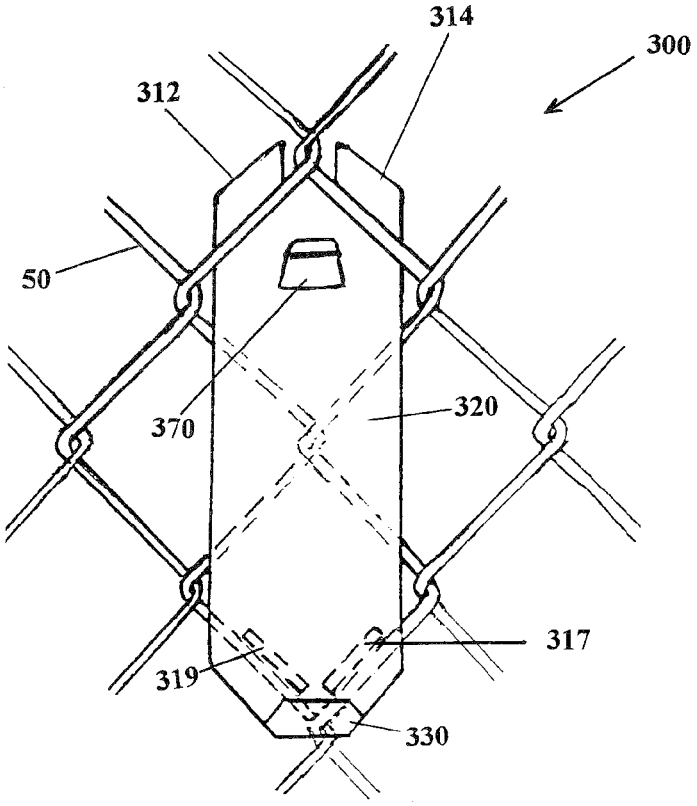
FIG. 8 is a front view of a holder in accordance with a second embodiment of the present invention.
Figure 9:
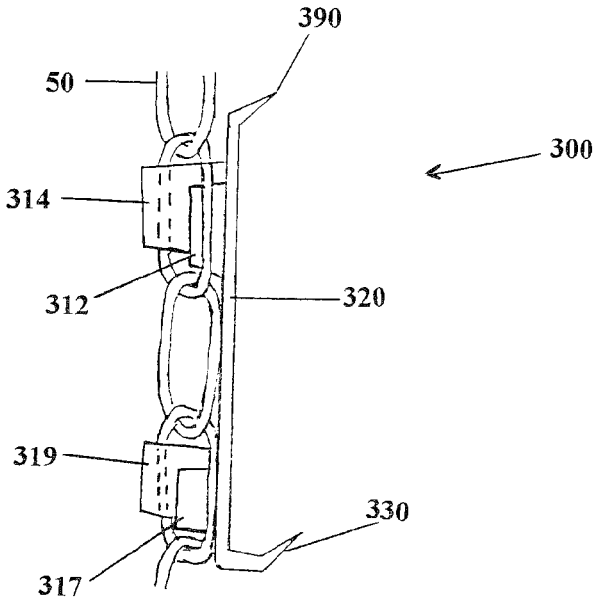
FIG. 9 is a side view of the holder shown in FIG. 8.

Referring to FIG. 8, this shows a front view of a holder 300 in accordance with a second embodiment of the present invention. Moreover, a side view of this holder 300 in accordance with the second embodiment is shown in FIG. 9. To the extent that the holder 300 in accordance with the second embodiment described with reference to FIGS. 8 and 9 is similar in structure and/or function to the holder 100 of the first embodiment described above with reference to FIGS. 1 through 5, like parts are given like-numbered reference numerals and description thereof is omitted for brevity.

Before proceeding with description of the second embodiment with reference to FIGS. 8 and 9, the reader should be cautioned on a couple of points bearing on how the second embodiment is portrayed in FIGS. 8 and 9.

The first point on which to caution the reader is that, upon comparing FIGS. 8 and 9, it may be noted that the dog ears 312, 314 at the top of the holder 300, which appear to be respectively angled approximately 45 degrees to either side of the vertical as seen in the front view of FIG. 8, appear in the side view of FIG. 9 to respectively be almost 90 degrees from the vertical such that the dog ears 312, 314 in FIG. 9 are approximately 180 degrees apart so as to almost be in a horizontal line. For purposes of the present description, the approximately 45-degree angled configuration shown in FIG. 8 is taken as accurate, the reader being asked to adjust in his mind's eye the geometry shown in FIG. 9 to conform to the configuration shown in FIG. 8.

Another point on which to caution the reader is with respect to the dimensions of the dog ears 312, 314 at the top of the holder 300 relative to the size of the holes in the meshwork of the chain link fence 50 as seen in FIG. 8. That is, as will be described below, the holder 300 of the second embodiment is designed to angle-in and angle-out of the chain link fence 50. Borrowing from aeronautical terminology, angle-in and angle-out as used here predominantly refers to angled motion in the "pitch" direction. However, as seen in the front view of FIG. 8, the distance between the corner at far left of the top shallow dog ear 312 and the corner at far right of the top deep dog ear 314 appears slightly wider than the diagonal of the diamond-shaped meshwork hole of the chain link fence 50, meaning that during insertion there would also necessarily be some angled motion in the "yaw" direction so as to be able to cause the top dog ears 312, 314 to clear the edges of the meshwork hole as the holder 300 is inserted in or removed from the chain link fence 50. One of skill in the art will appreciate that with slight modification to the top dog ears 312, 314 of the holder 300 it would be possible to insert the holder 300 into the meshwork hole of the chain link fence 50, and remove the holder 300 therefrom, with only angled motion in the "pitch" direction. For example, the aforementioned corner at far left of the top shallow dog ear 312 and corner at far right of the top deep dog ear 314 could be removed, the lengths of the top dog ears 312, 314 could be shortened, the respective angles of the top dog ears 312, 314 relative to the vertical could be made shallower, the widths of the top dog ears 312, 314 could be made more narrow, and/or the locations at which the top dog ears 312, 314 emerge from the base 320 could be shifted upward in inclined fashion along their present angles with respect to the vertical as viewed in FIG. 8 so that the aforementioned corner at far left of the top shallow dog ear 312 and corner at far right of the top deep dog ear 314 do not respectively extend beyond lines drawn parallel to the sides at the central portion of the base 320.

Instead of shallow legs 102, 102 and deep legs 104, 104 as at the holder 100 of the first embodiment shown in FIGS. 1 through 5, the holder 300 of the second embodiment shown in FIGS. 8 and 9 has a top shallow dog ear 312 and a top deep dog ear 314, and has a bottom shallow stop 317 and a bottom deep stop 319.

Moreover, the holder 300 of the second embodiment shown in FIGS. 8 and 9 has a floor 330 and a roof 370. To emphasize the fact that the holder 300 of the second embodiment may be capable of supporting heavy objects without becoming dislodged from the chain link fence 50 as a result of rotation in the "pitch" direction due to torque thereon caused by the force of gravity, the floor 330 and the roof 370 of the second embodiment are hook-like in shape so as to permit a heavy object such as a duffle bag to be suspended therefrom.

The top shallow dog ear 312 of the second embodiment shown in FIGS. 8 and 9 is similar to one of the shallow legs 102 of the first embodiment shown in FIGS. 1 through 5, and the top deep dog ear 314 of the second embodiment shown in FIGS. 8 and 9 is similar to one of the deep legs 104 of the first embodiment shown in FIGS. 1 through 5, in that the top dog ears 312, 314 of the second embodiment shown in FIGS. 8 and 9 are splayed tabs serving as engaging features to prevent movement of the holder 300 in a frontward direction when the holder 300 is in its installed configuration on a chain link fence 50, but are different therefrom in that the top dog ears 312, 314 of the second embodiment shown in FIGS. 8 and 9 may generally be longer than the corresponding legs 102, 104 of the first embodiment shown in FIGS. 1 through 5 so long as angle-in/angle-out installation is permitted thereby. As discussed above with reference to examples of the first embodiment employing splayed tabs as engaging features, to prevent play in the front-to-back direction it is preferred that the depths of the top shallow dog ear 312 and the top deep dog ear 314 relative to the back face of the base 320 be chosen so as to permit a more or less flush installed configuration when the holder 300 is installed on the chain link fence 50.

The bottom shallow stop 317 of the second embodiment shown in FIGS. 8 and 9 is similar to one of the shallow legs 102 of the first embodiment shown in FIGS. 1 through 5, and the bottom deep stop 319 of the second embodiment shown in FIGS. 8 and 9 is similar to one of the deep legs 104 of the first embodiment shown in FIGS. 1 through 5, in that the bottom stops 317, 319 of the second embodiment shown in FIGS. 8 and 9 respectively engage with wire in the shallow and deep planes of the chain link fence 50, but are different therefrom in that the bottom stops 317, 319 of the second embodiment shown in FIGS. 8 and 9 predominantly serve as engaging features to prevent movement of the holder 300 in a downward direction when the holder 300 is in its installed configuration on a chain link fence 50 but do not necessarily serve as engaging features to prevent movement of the holder 300 in the front-to-back direction when the holder 300 is in its installed configuration thereon. That is, as best seen at FIG. 8, the bottom stops 317, 319 in the embodiment shown do not have splayed tabs but instead project straight back, i.e., in perpendicular fashion, from the base 320, the bottom stops 317, 319 merely resting on wire of the chain link fence 50 as weight from one or more objects suspended from the floor 330 and/or the roof 370 causes the bottom-facing surfaces of the bottom stops 317, 319 to contact the top-facing surfaces of the wire of the chain link fence 50.

However, as a first variation on the second embodiment shown in FIG. 8, the bottom stops 317, 319 may have splayed tabs as engaging features to additionally prevent play in the frontward direction, in which case it is preferred that such splayed tabs be short enough not to interfere with angle-in/angle-out installation.

Alternatively, as a second variation on the second embodiment shown in FIG. 8, the bottom stops 317, 319 may be without splayed tabs as at the embodiment shown in FIG. 8, but unlike the embodiment shown in FIG. 8 be of such shape and/or orientation as to each only contact the wire of the chain link fence 50 at substantially a single point. For example, in such a second variation on the second embodiment shown in FIG. 8, the bottom stops 317, 319 of the embodiment shown in FIG. 8 may be replaced by pole-like projections protruding straight back, i.e., in perpendicular fashion, from the base 320, or the bottom stops 317, 319 in such a second variation on the second embodiment shown in FIG. 8 might alternatively be of size and shape as shown in FIG. 8 but each be respectively rotated 90 degrees relative to the configuration shown in FIG. 8 so that instead of abutting the wire of the chain link fence 50 side-on or in parallel fashion as in the embodiment shown in FIG. 8, the bottom stops 317, 319 abut the wire of the chain link fence 50 end-on or in perpendicular fashion.

Whereas the holders 100, 200, 300 of the first embodiment and variations thereon shown in FIGS. 1 through 7 are designed for straight-in/straight-out installation or twist-in/twist-out installation, the holder 300 of the second embodiment shown in FIGS. 8 and 9 is designed for angle-in/angle-out installation. That is, referring to FIGS. 8 and 9, to install the holder 300 of the second embodiment on a chain link fence 50, the holder 300 would be held in horizontal fashion such that the floor 330 and the roof 370 are directed upward, the top dog ears 312, 314 would be inserted into the meshwork hole of the chain link fence 50, the holder 300 would be rotated in the "pitch" direction in such fashion as to raise the top dog ears 312, 314 and lower the bottom stops 317, 319, at which time the top dog ears 312, 314 would be made to slide behind the wire of the chain link fence 50, and the back face of the base 320 would be pressed against the chain link fence 50 until the bottom stops 317, 319 come into position above the wire of the chain link fence 50, following which the holder 300 would be lowered until the bottom stops 317, 319 come to rest against the wire of the chain link fence 50. Removal would be the reverse of installation.

Note that the base 320 of the holder 300 in the second embodiment shown in FIGS. 8 and 9 is longer than the base 120 of the holders 100, 700, 200 of the first embodiment and variations thereon shown in FIGS. 1 through 7. That is, the critical surfaces of the engaging features on the legs 102, 104 in the first embodiment and variations thereon shown in FIGS. 1 through 7 are mutually separated by distances on the order of one times the nominal hole size of the chain link fence 50. In the second embodiment shown in FIGS. 8 and 9, the critical surfaces of the engaging features on the top dog ears 312, 314 are mutually separated by distances on the order of one times the nominal hole size of the chain link fence 50, and the critical surfaces of the engaging features on the bottom stops 317, 319 are mutually separated by distances on the order of one times the nominal hole size of the chain link fence 50. However, in the second embodiment shown in FIGS. 8 and 9, the engaging features on the top dog ears 312, 314 are separated from the engaging features on the bottom stops 317, 319 by distances on the order of two times the nominal hole size of the chain link fence 50. In other words, whereas the holders 100, 700, 200 of the first embodiment and variations thereon shown in FIGS. 1 through 7 straddle a single hole of the chain link fence 50, the holder 300 of the second embodiment shown in FIGS. 8 and 9 straddles two holes of the chain link fence 50, and one of skill in the art will appreciate that more than two holes can be straddled by holders in accordance with the present invention and that a great many similar variations are possible that allow flexibility in size and shape while still permitting the engaging features to engage with the wire of the chain link fence 50. There is therefore no limitation regarding whether engagement of the wire of the chain link fence 50 by the respective engaging features in holders in accordance with the present invention occurs at the same hole or at different holes. Moreover, while there is no particular objection to employment of a longer base at the first embodiment or a shorter base at the second embodiment, the base is shown as longer in the second embodiment in FIGS. 8 and 9 than in the first embodiment and variations thereon in FIGS. 1 through 7 because such a longer base is thought to be preferred for designs employing angle-in/angle-out installation.

In the embodiment shown in FIG. 8, while there is no particular objection to employment of elastic materials, because angle-in/angle-out installation requires neither an inwardly sprung nor an outwardly sprung design, comparatively inelastic materials such as metal may be employed in the holder 300 of the second embodiment. Note, moreover, that the angle-in/angle-out installation permits a relatively flat profile for the holder 300, facilitating storage and transportation.

At FIG. 8, dashed lines indicate possible variations on the structure shown in solid line. For example, the vertically elongated octagonal profile shown in dashed line indicates the outline of a faceplate that might replace the base 320 shown in solid line or that might be connected to and extend in a plane in front of the base 320 shown in solid line at FIG. 8. Furthermore, the curved profile shown in dashed line indicates the outline of a cuplike receptacle, in which drinks and the like can be placed, that might protrude toward the front from the base 320.

Figure 10:
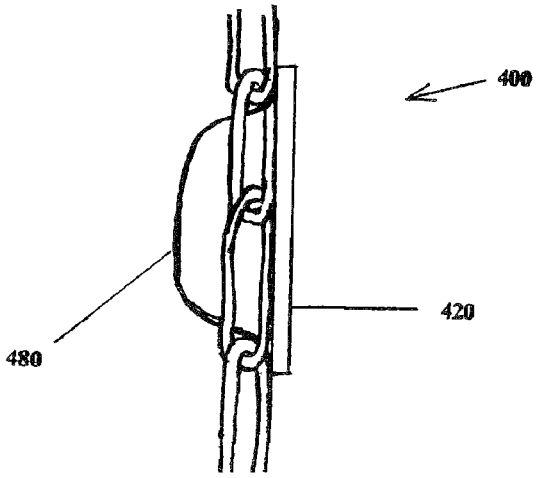
FIG. 10 is a side view of a holder in accordance with a third embodiment of the present invention.

Referring to FIG. 10, this shows a holder 400 in accordance with a third embodiment of the present invention. To the extent that the holder 400 in accordance with the third embodiment described with reference to FIG. 10 is similar in structure and/or function to the holder 100 of the first embodiment described above with reference to FIGS. 1 through 5, like parts are given like-numbered reference numerals and description thereof is omitted for brevity.

At the holder 400 shown in FIG. 10, deformable elastic material 480 such as sponge rubber, thermoplastic or thermosetting resin foam, or solid or hollow rubber or rubber-like material is attached to a base 420. The deformable elastic material 480 is of such dimensions and material properties as to allow it to be pressed into a meshwork hole in a chain link fence 50 and become lodged therein. Moreover, dimensions and material properties of the deformable elastic material 480 allow the holder 400 to be removed from the meshwork hole in the chain link fence 50 when pulled out therefrom. Although omitted for ease of description, any of a variety of suitable holding features for holding drinks or other objects such as those described with reference to FIGS. 1 through 9 or 11 through 15 may be provided at the front of the base 420.

Figure 11:
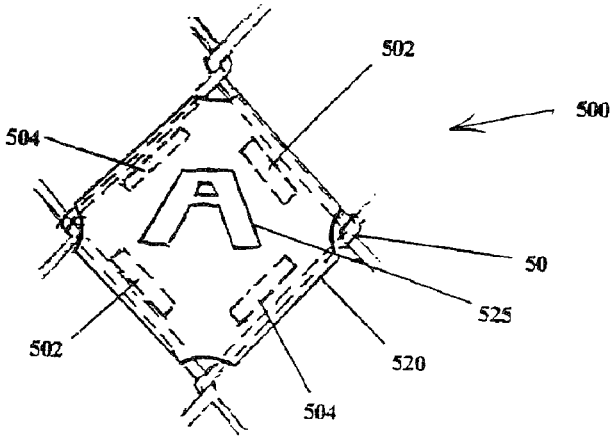
FIG. 11 is a front view of signage on a holder in accordance with a fourth embodiment of the present invention.
Figure 12:
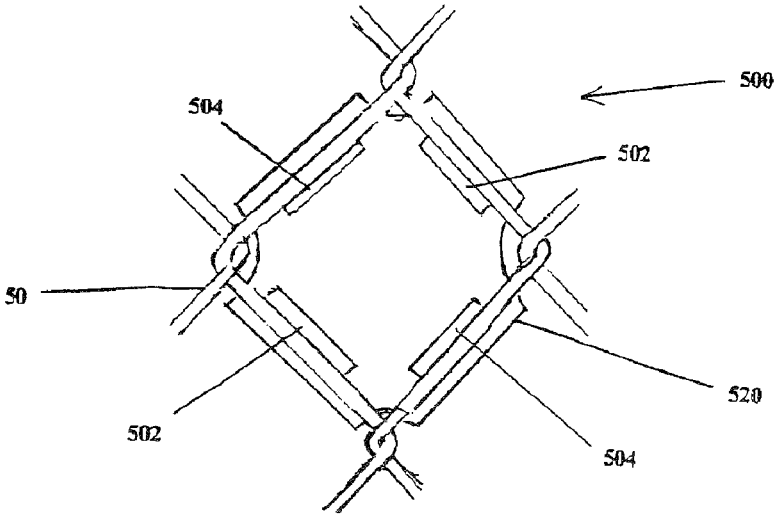
FIG. 12 is a rear view of the signage shown in FIG. 11.

Signage 500 in accordance with a fourth embodiment of the present invention is shown in FIGS. 11 and 12, FIG. 11 being a front view thereof and FIG. 12 being a rear view thereof. To the extent that the signage 500 in accordance with the fourth embodiment described with reference to FIGS. 11 and 12 is similar in structure and/or function to one or more of the holders described above, like parts are given like-numbered reference numerals and description thereof is omitted for brevity. In the fourth embodiment shown in FIGS. 11 and 12, a pair of shallow legs 502, 502 engage with wire in the shallow plane of the chain link fence 50, and a pair of deep legs 504, 504 engage with wire in the deep plane of the chain link fence 50. Attached at the front of the signage 500 of the fourth embodiment is a diamond-shaped base 520 on which a symbol 525 such as the letter "A" is depicted. While the letter "A" has been shown as an example, any such symbol, including any of a variety of letters and/or numerals, may be depicted on the base 520. By inserting signage 500 depicting appropriate symbols 525 into the meshwork holes of a chain link fence 50 in a suitable pattern, it is possible to spell out or otherwise communicate an intended message.

Figure 13:
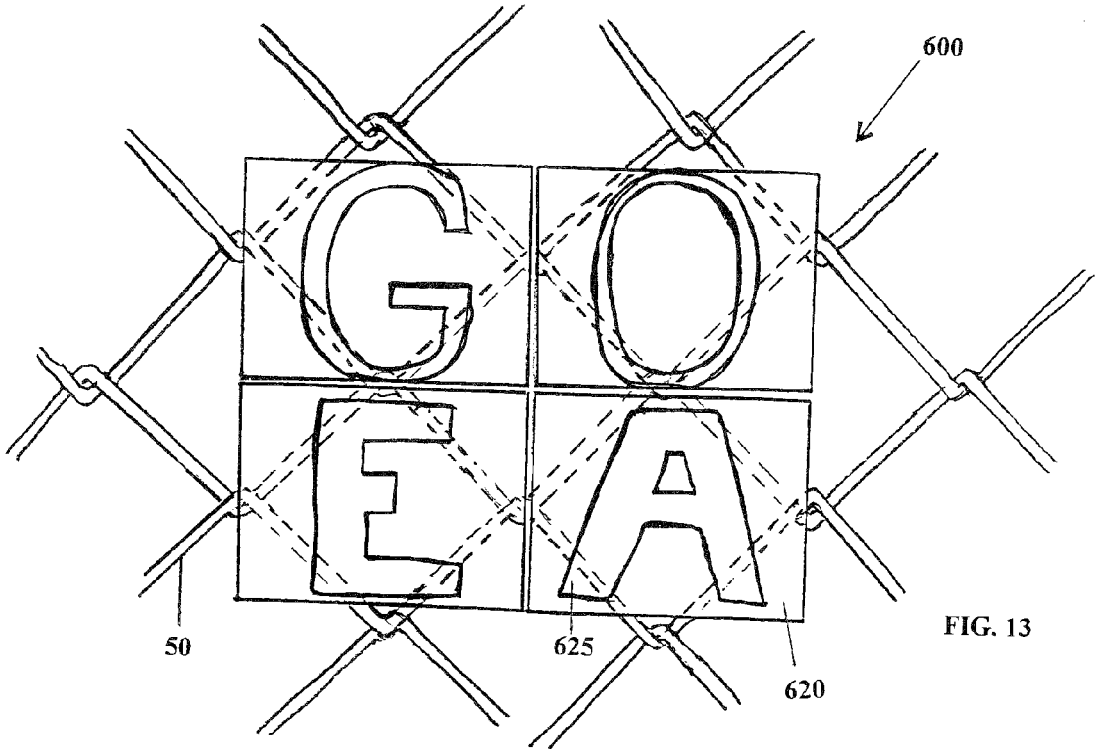
FIG. 13 is a front view of signage in accordance with a fifth embodiment of the present invention.

Signage 600 in accordance with a fifth embodiment of the present invention is shown in FIG. 13. To the extent that the signage 600 in accordance with the fifth embodiment described with reference to FIG. 13 is similar in structure and/or function to the signage 500 of the fourth embodiment described above with reference to FIGS. 11 and 12, like parts are given like-numbered reference numerals and description thereof is omitted for brevity. Attached at the front of the signage 600 of the fifth embodiment are square or rectangular bases 620 on which symbols 625 such as letters of the alphabet are depicted. By inserting signage 600 depicting appropriate symbols 625 into the meshwork holes of a chain link fence 50 in a suitable pattern, it is possible to spell out or otherwise communicate an intended message.

Figure 14:
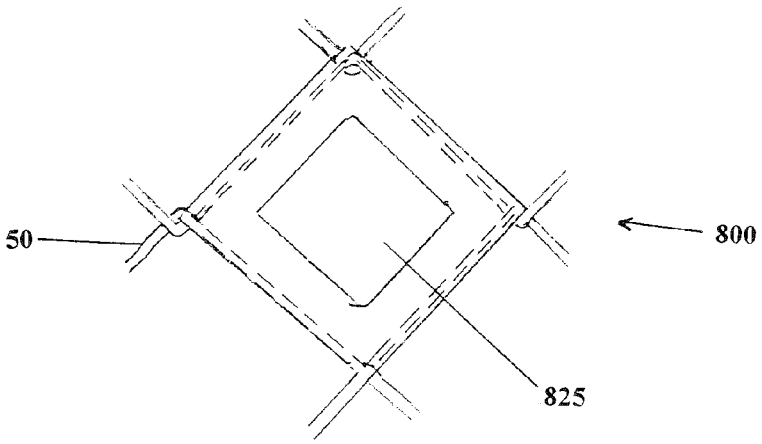
FIG. 14 is a front view of an attachment plate in accordance with a sixth embodiment of the present invention.
Figure 15:
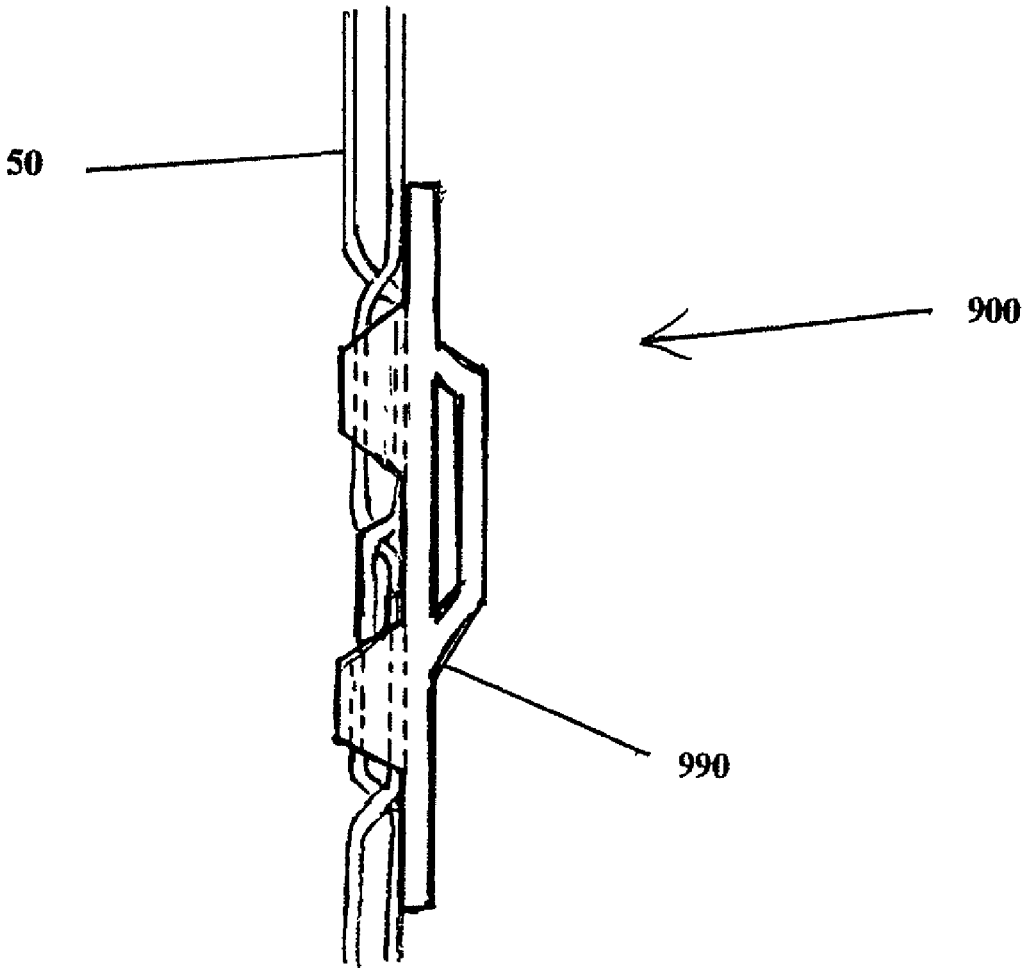
FIG. 15 is a side view of an attachment plate in accordance with a seventh embodiment of the present invention.

FIGS. 14 and 15 respectively show attachment plates 800, 900 in accordance with sixth and seventh embodiments of the present invention. To the extent that the attachment plates 800, 900 in accordance with the sixth and seventh embodiments respectively described with reference to FIGS. 14 and 15 are similar in structure and/or function to one or more of the holders described above, like parts are given like-numbered reference numerals and description thereof is omitted for brevity.

At the front of the attachment plate 800 of the sixth embodiment shown in FIG. 14 is a base bearing one component 885 of a hook-and-loop fastener system or other such two-component fastener system such as Velcro® (registered trademark of Velcro Industries B.V. of Manchester, N.H., USA). When the attachment plate 800 of the sixth embodiment is installed on a chain link fence 50, the other component of such two-component fastener system may be conveniently attached thereto and removed therefrom as desired.

At the front of the attachment plate 900 of the seventh embodiment shown in FIG. 15 is a base bearing a tiedown loop 990 to which any of a variety of fastening media such as tiewraps, rope, cord, wire, or the like may be tied or otherwise fastened. When the attachment plate 900 of the seventh embodiment is installed on a chain link fence 50, one or more tiewraps or other such cable tie or other fastening media may be conveniently attached thereto and removed therefrom as desired.

Figure 16:
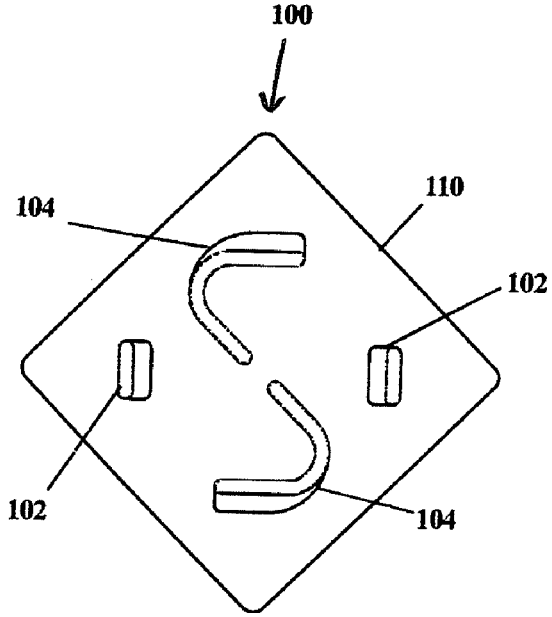
FIG. 16 is a rear view of the holder of FIG. 1 showing an alternative implementation of the legs of the present invention.
Figure 17:
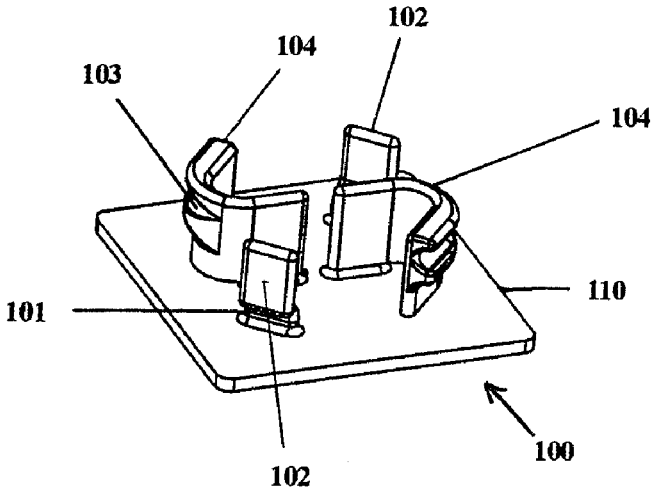
FIG. 17 is an angled view of the alternative implementation of the legs of the present invention shown in FIG. 16.

FIGS. 16 and 17 respectively show a rear view and an angled view of an alternative implementation of the legs of the holder of FIG. 1. Under this implementation, the deep legs 104 are configured in an S-shaped fashion, so that the legs are attached to back face 110 at the center portion of the S. The engaging features 103 are attached at the ends of deep legs 104. As depicted in FIG. 17, each engaging feature 103 is a groove having an upper and lower lip to engage a chain link wire. However, there is no objection to the engaging feature 103 being a single lip to engage a chain link wire. In this implementation, shallow legs 102 are proportionately shorter than deep legs 104, and engaging features 101 are located on shallow legs 102. As with engaging feature 103, engaging feature 101 may be a groove or a single lip. In implementations where engaging feature 101 is a single lip, the back face 110 may work in cooperation with engaging feature 101 to engage a chain link wire.

The deep legs 104 attach to the back face 110 near where the top and bottom of the S meet in the center. The top and bottom ends of the S, where the engaging features 103 connect to deep legs 104, float free from the back face 110, allowing the engaging features 103 to flex inward toward the center of the back face 110. This flexibility may allow the S-shaped configuration of FIGS. 16 and 17 to facilitate both snap-in/snap-out and twist-in/twist-out installation of the holder with a chain link fence, as discussed earlier. While this arrangement of the legs has been discussed in connection with holder embodiments, it should be understood that this arrangement is also applicable to other embodiments, such as signage (FIG. 11), hook and loop (FIG. 14) and clips (FIG. 15).

Figure 18A:
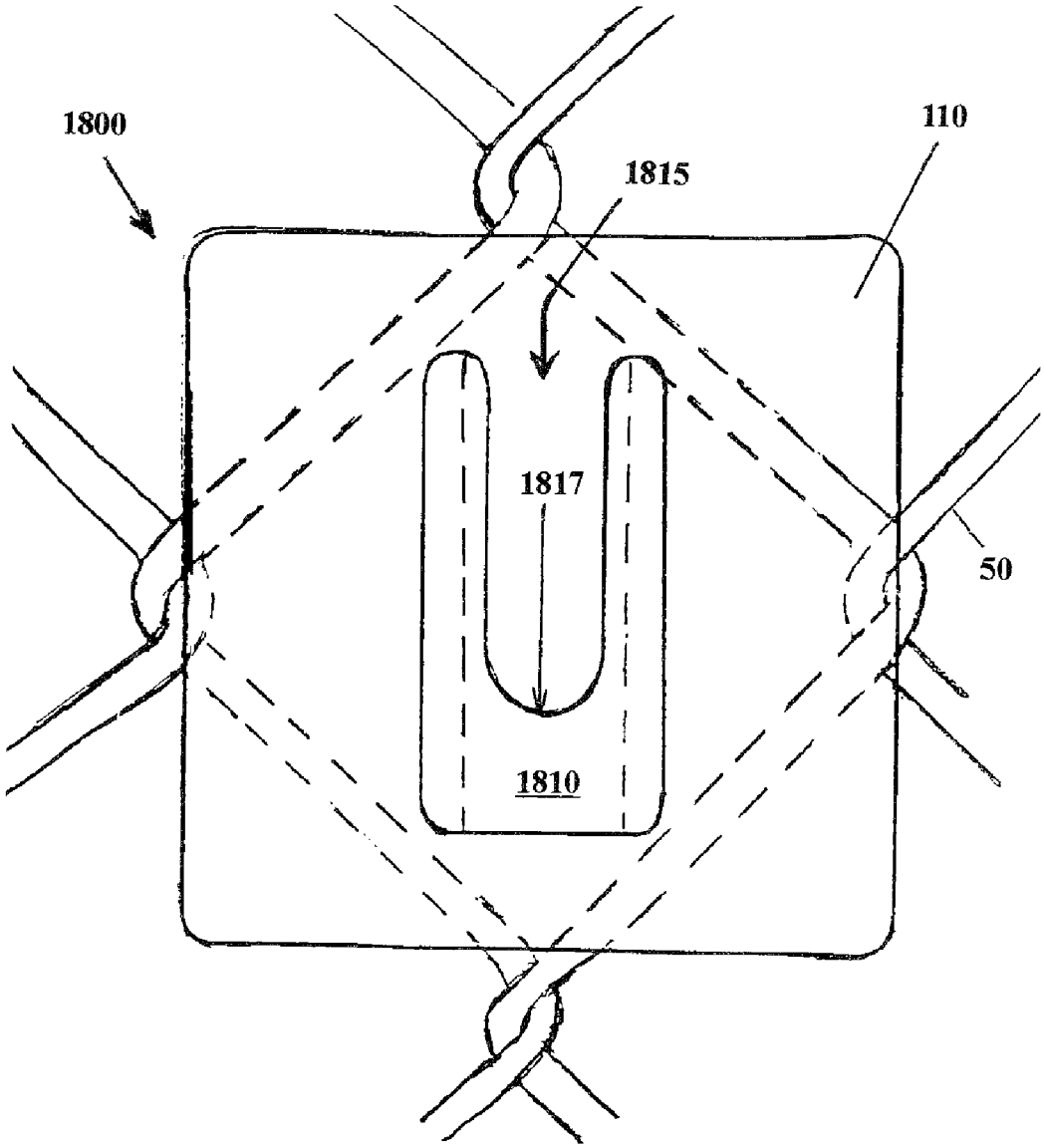
FIG. 18 collectively shows a front view, FIG. 18A, a side view, FIG. 18B, and a top view, FIG. 18C, of an eighth embodiment of the present invention.
Figure 18B:
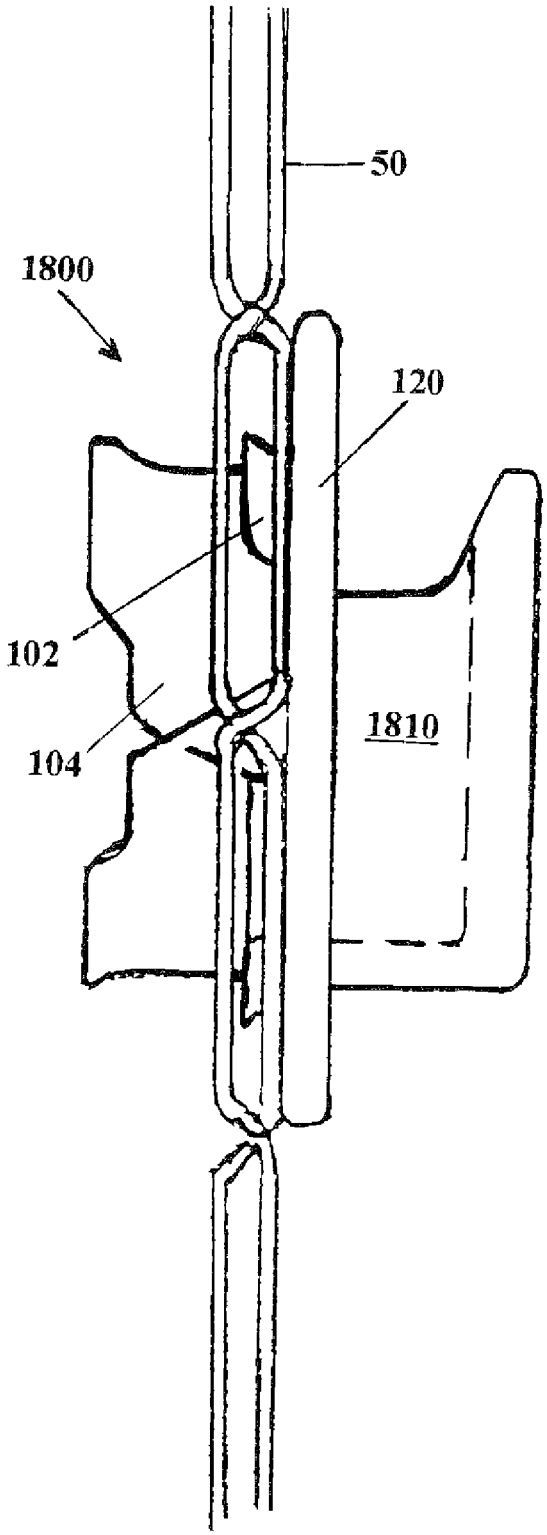
Figure 18C:
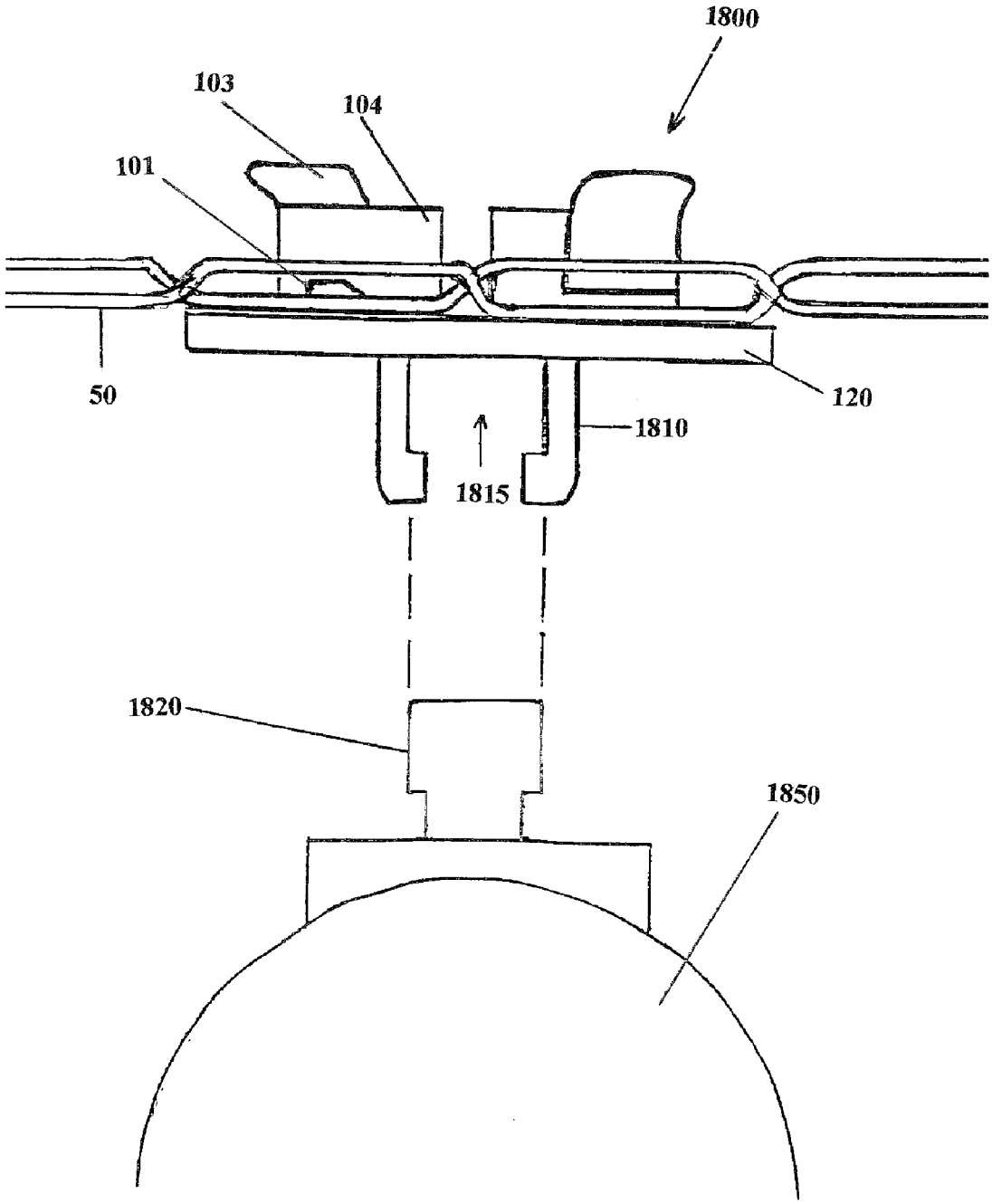

FIG. 18 collectively shows a front view, FIG. 18A, a side view, FIG. 18B, and a top view, FIG. 18C, of an eighth embodiment of the present invention. Please note that where possible similar elements retain their numbers from earlier embodiments. The eighth embodiment provides a holder

1800 with a clasp system with a female member 1810 and a male member 1820. The female member 1810 is attached to a back face 110 of a base 120. The base 120 attaches to a chain link fence 50, in a similar fashion to previous embodiments, such as shown in FIGS. 16 and 17, with legs 102, 104 and engaging features 101, 103. As shown in FIG. 18, the female member 1810 and the male member 1820 may cooperate as a sliding tongue-and-groove mechanism, where the female member 1810 may be a slot 1815 with a U-shaped base 1817 when viewed from the front, and where the male member 1820 is a peg with a T-shaped profile when viewed from the top. The female member 1820 receives the male member 1810 in the top of the slot 1815, and the male member 1820 slides down the slot 1815 until coming to rest at the U-shaped base 1817.

The clasp system male member 1820 is attached to an accessory attachment 1850. The clasp system allows a single holder 1800 support several interchangeable accessory attachments 1850. The accessory attachment 1850 may be, among other things, a beverage holder, a hook, a utility shelf, or a basket.

While FIG. 18 depicts the clasp system with female member 1810 and male member 1820 arranged as a sliding tongue-and-groove mechanism, a person having ordinary skill in the art will recognize that many variations of a clasp system are possible within the scope of this invention, such as a snap joint, a dovetail joint, or a friction mount. Similarly, while the clasp system in FIG. 18 depicts the female member 1810 attached to base 120 and the male member 1820 attached to the accessory attachment 1850, this does not limit implementations where the male member is attached to the base and the female member is attached to the accessory attachment, or other clasping arrangements.

Although the present invention has been described in terms of examples in which the invention is applied to holders such as drink holders, signage, and attachment plates, the present invention is not limited thereto, it being possible to apply the gripping portion of the holder to all manner of holders for holding any of a wide variety of objects to a chain link fence.

Furthermore, although description of the present invention herein includes examples in which legs project more or less straight back, i.e., in perpendicular fashion, from a base of a holder, it may be preferred for compactness of design and/or ease of installation in some embodiments that the legs, e.g., in the outwardly sprung design described above, respectively make an angle of less than 90 degrees with the back face of the base so as to taper inward distally such that the leg ends approach an axis drawn perpendicularly rearward from a central point on the back face of the base of the holder when the holder is in its uninstalled configuration and the legs are in their undeflected state.

Moreover, although the present invention has been described in terms of an example in which a holder is attached to a chain link fence made up of 9 gauge (approximate diameter 0.15 inch) wire interwoven to form diamond-shaped holes that are 2 inches on a side, with an approximate difference of 0.5 inch between shallow and deep planes, the present invention is not limited thereto, it being possible to apply the invention to any of a wide variety of chain link fences, with appropriate modification to the dimensions of the holder.

As described above, holders in accordance with various embodiments of the present invention solve one or more of the problems mentioned above, and may also provide other advantages and benefits.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention.

What is claimed is:

1. An apparatus for attaching items to a chain link fence, the chain link fence having a plurality of generally diamond-shaped openings, each generally diamond-shaped opening framed by a first pair of substantially parallel frame wires disposed in a shallow plane and a second pair of substantially parallel frame wires disposed in a deep plane, the shallow plane being substantially parallel to the deep plane, the apparatus comprising:

a generally flat base having a fence attachment side and a utility side disposed opposite the fence attachment side, and a perimeter bounded by a base perimeter edge; and a plurality of legs, each leg comprising a proximal end attached to the base fence attachment side substantially within the base perimeter, a distal end projecting outward from the plane of the base, and a wire engaging feature attached to the distal end, the plurality of legs further comprising;

a deep pair of legs comprising a first deep leg and a second deep leg, the deep pair of legs each having a first length, the deep pair of legs being positioned such that when the apparatus is attached to a chain link fence the wire engaging feature of the first deep leg is disposed adjacent to a first frame wire in the deep plane, and the wire engaging feature of the second deep leg is disposed adjacent to a second frame wire in the deep plane; and a shallow pair of legs comprising a first shallow leg and a second shallow leg, the shallow pair of legs each having a second length, the second length being shorter than the first length, the shallow pair of legs being positioned such that when the apparatus is attached to a chain link fence the wire engaging feature of the first shallow leg is disposed adjacent to a first frame wire in the shallow plane, and the wire engaging feature of the second shallow leg is disposed adjacent to a second frame wire in the shallow plane.

2. The apparatus of claim 1, wherein the shallow pair of legs and the deep pair of legs are configured to be disposed within a single diamond-shape hole in the chain link fence.

3. The apparatus of claim 2, wherein the apparatus is configured to be fastened to the chain link fence by inserting the shallow pair of legs and the deep pair of legs through the single diamond-shape hole and rotating the base approximately 45 degrees.

4. The apparatus of claim 3 further comprising a rotation stop attached to an engaging member.

5. The apparatus of claim 1, wherein the apparatus is formed of a semi-rigid material such that at least two legs can flex to facilitate insertion of the legs through a diamond-shaped hole.

6. The apparatus of claim 5, wherein the apparatus is configured for fastening to the chain link fence by flexing a leg to displace an engaging member sufficiently to insert the legs through at least one diamond-shape hole.

7. The apparatus of claim 6, wherein the first shallow leg and the first deep leg are configured to be disposed within a first diamond-shaped hole in the chain link fence, and the second shallow leg and the second deep leg are configured to be disposed within a second diamond-shaped hole in the chain link fence.

8. The apparatus of claim 7, wherein the base utility side is integral to the side of a bottle.

9. The apparatus of claim 1, wherein the engaging feature comprises a lip projecting substantially outward from the leg at an angle in a range between 30 and 90 degrees, such that the lip partially wraps around a framing wire.

10. The apparatus of claim 1, wherein the engaging feature comprises an upper lip projecting outward from the leg and a lower lip projecting outward from the leg, the upper lip and lower lip being substantially parallel and spaced as to form a groove to clasp a framing wire.

11. The apparatus of claim 1, wherein the apparatus is formed of a deformable elastic material.

12. The apparatus of claim 1, wherein the base utility side further comprises a substantially flat surface displaying a symbol.

13. The apparatus of claim 1, wherein the base utility side further comprises a beverage holder attached to the base utility side.

14. The apparatus of claim 13, wherein the beverage holder further comprises a ledge having a proximal portion attached to the base, a ledge middle portion extending substantially horizontally outward from the base for supporting a beverage container, and a ledge distal portion that projects substantially vertically upward from the ledge middle portion for securing the beverage container and connecting to the ledge middle portion at a ledge elbow, the ledge elbow forming substantially a right angle between the ledge middle portion and the ledge distal portion.

15. The apparatus of claim 14, wherein the ledge elbow comprises a first hinge, and the apparatus further comprising a second hinge connecting the ledge proximal portion to the ledge middle portion.

16. The apparatus of claim 1, wherein the base utility side further comprises a surface bearing one component of a hook-and-loop fastener system.

17. The apparatus of claim 1, wherein the base utility side further comprises a tiedown loop.

18. A method for manufacturing a chain link fence fastener apparatus, comprising the steps of:

forming a generally flat base having a fence attachment side and a utility side disposed opposite the fence attachment side;

forming a plurality of legs, each leg comprising a proximal end attached to the base fence attachment side and a distal end projecting outward from the plane of the base, and a wire engaging feature attached to the distal end, the plurality of legs further comprising;

a deep pair of legs comprising a first deep leg and a second deep leg; and a shallow pair of legs comprising a first shallow leg and a second shallow leg, the shallow pair of legs being shorter than the deep pair of legs.

19. The method of claim 18, wherein forming comprises injection molding.

20. The method of claim 18, wherein forming comprises blow molding.

21. A system for attaching items to a chain link fence, the chain link fence having a plurality of generally diamond-shaped openings, each generally diamond-shaped opening framed by a first pair of substantially parallel frame wires disposed in a shallow plane and a second pair of substantially parallel frame wires disposed in a deep plane, the shallow plane being substantially parallel to the deep plane, the system comprising:

a generally flat base having a fence attachment side and a utility side disposed opposite the fence attachment side, and a perimeter bounded by a base perimeter edge;

a plurality of legs, each leg comprising a proximal end attached to the base fence attachment side substantially within the base perimeter, a distal end projecting outward from the plane of the base, and a wire engaging feature attached to the distal end, the plurality of legs further comprising;

a deep pair of legs comprising a first deep leg and a second deep leg, the deep pair of legs each having a first length, the deep pair of legs being positioned such that when the apparatus is attached to a chain link fence the wire engaging feature of the first deep leg is disposed adjacent to a first frame wire in the deep plane, and the wire engaging feature of the second deep leg is disposed adjacent to a second frame wire in the deep plane; and a shallow pair of legs comprising a first shallow leg and a second shallow leg, the shallow pair of legs each having a second length, the second length being shorter than the first length, the shallow pair of legs being positioned such that when the apparatus is attached to a chain link fence the wire engaging feature of the first shallow leg is disposed adjacent to a first frame wire in the shallow plane, and the wire engaging feature of the second shallow leg is disposed adjacent to a second frame wire in the shallow plane;

a clasp female member attached to the base utility fastener side;

a clasp male member removably attached to the clasp female member; and a holder, attached to the clasp male member.

22. The system of claim 21, wherein the holder comprises a beverage holder.

* * * * *